US006561870B2

(12) United States Patent
Saldana et al.

(10) Patent No.: US 6,561,870 B2
(45) Date of Patent: May 13, 2003

(54) ADJUSTABLE FORCE APPLYING AIR PLATEN AND SPINDLE SYSTEM, AND METHODS FOR USING THE SAME

(75) Inventors: Miguel A. Saldana, Fremont, CA (US); Aleksander A. Owczarz, San Jose, CA (US)

(73) Assignee: Lam Research Corporation, Fremont, CA (US)

( * ) Notice: Subject to any disclaimer, the term of this patent is extended or adjusted under 35 U.S.C. 154(b) by 87 days.

(21) Appl. No.: 09/823,593

(22) Filed: Mar. 30, 2001

(65) Prior Publication Data

US 2002/0142710 A1 Oct. 3, 2002

(51) Int. Cl.[7] ..... B24B 49/16
(52) U.S. Cl. ..... 451/10; 451/41; 451/288
(58) Field of Search ..... 451/10, 41, 285–289, 451/296, 303, 307

(56) References Cited

U.S. PATENT DOCUMENTS 6,108,091 A * 8/2000 Pecen et al. ..... 356/369
6,111,634 A * 8/2000 Pecen et al. ..... 250/559.27
6,146,248 A * 11/2000 Jairath et al. ..... 451/10
6,261,155 B1 * 7/2001 Jairath et al. ..... 451/10
6,419,559 B1 * 7/2002 Gurusamy et al. ..... 451/41

FOREIGN PATENT DOCUMENTS

JP 410144709 A * 5/1998 ..... H01L/21/56

* cited by examiner

*Primary Examiner*—Joseph J. Hail, III
*Assistant Examiner*—David B. Thomas
(74) *Attorney, Agent, or Firm*—Martine & Penilla, LLP

(57) ABSTRACT

An adjustable platen is provided. The adjustable platen includes a platen body having a top region and a bottom region. The platen body is oriented under a linear polishing pad of a CMP system. An air bearing is integrated with the platen body at the top region, and the air bearing is configured to apply an air pressure to an underside of the linear polishing pad. A set of bearings are connected to the bottom region of the platen body to enable controlled vertical movement of the top region of the platen body closer or further from the underside of the linear polishing pad depending on the applied air pressure. The applied air pressure is configured to exert a controllable force to the underside of the linear polishing pad. The force is controlled to meet a desired process parameters, while the carrier simply moves the wafer into position over the linear polishing pad.

19 Claims, 6 Drawing Sheets

ADJUSTABLE FORCE APPLYING AIR PLATEN AND SPINDLE SYSTEM, AND METHODS FOR USING THE SAME

BACKGROUND OF THE INVENTION

1. Field of the Invention

This invention relates generally to chemical mechanical planarization (CMP) systems, and more particularly, to systems having force applying air platens.

2. Description of the Related Art

In the fabrication of semiconductor devices, there is a need to perform Chemical Mechanical Planarization (CMP) operations, including polishing, buffing and wafer cleaning. Typically, integrated circuit devices are in the form of multi-level structures. At the substrate level, transistor devices having diffusion regions are formed. In subsequent levels, interconnect metallization lines are patterned and electrically connected to the transistor devices to define the desired functional device. As is well known, patterned conductive layers are insulated from other conductive layers by dielectric materials, such as silicon dioxide. As more metallization levels and associated dielectric layers are formed, the need to planarize the dielectric material increases. Without planarization, fabrication of additional metallization layers becomes substantially more difficult due to the higher variations in the surface topography. In other applications, metallization line patterns are formed in the dielectric material, and then metal CMP operations are performed to remove excess metallization.

In the prior art, CMP systems typically implement belt, orbital, or brush stations in which belts, pads, or brushes are used to scrub, buff, and polish one or both sides of a wafer. Slurry is used to facilitate and enhance the CMP operation. Slurry is most usually introduced onto a moving preparation surface, e.g., belt, pad, brush, and the like, and distributed over the preparation surface as well as the surface of the semiconductor wafer being buffed, polished, or otherwise prepared by the CMP process. The distribution is generally accomplished by a combination of the movement of the preparation surface, the movement of the semiconductor wafer and the friction created between the semiconductor wafer and the preparation surface.

FIG. 1 illustrates an exemplary prior art CMP system 10. The CMP system 10 in FIG. 1 is a belt-type system, so designated because the preparation surface is an endless belt-type polishing pad 18 mounted on two drums 24 which drive the pad in a rotational motion as indicated by belt rotation directional arrows 26. A wafer 12 is mounted on a carrier 14. The carrier 14 is rotated in direction 16, which can be either clockwise or counterclockwise. The rotating wafer 12 is then applied against the polishing pad 18 with a force F to accomplish a CMP process. Some CMP processes require significant force F to be applied and monitored. A platen 22 is provided to stabilize the polishing pad 18 and to provide a support onto which to apply the wafer 12. The platen 22 is designed with an air bearing 23, which is designed to supply a constant flow of air during movement of the polishing pad 18. The constant flow of air therefore provides a consistent cushion over which the polishing pad 18 can traverse. To facilitate polishing, slurry 28 composed of an aqueous solution such as $NH_4OH$ or DI containing dispersed abrasive particles is introduced upstream of the wafer 12.

Typically, a load cell (LC) is integrated as part of the carrier 14 to enable monitoring of the pressure being applied to the wafer during processing. In practice, the carrier 14 is lowered onto the polishing pad 18 while the wafer is rotated in the direction 16. In addition to being lowered, the load cell (LC) is designed to provide pressure data to monitoring electronics. If more or less pressure is needed for a particular process, the spindle is instructed to make the pressure adjustment. Accordingly, not only is the spindle designed to move up and down, rotate at a particular rate, but also continuously adjust the force on the wafer (in the form of pressure) as transmitted by the carrier 14 to achieve the appropriate CMP parameters.

Because the carrier 14 is designed to place a force onto a moving polishing pad 18, frictional forces will build at the spindle so as to generate mechanical hysteresis. These frictional forces are known to reduce an actuator's (which is designed to apply a force to the carrier 14) ability to maintain a constant force during small amplitude variations in carrier 14 vertical position during polishing. The challenge of maintaining a constant force during precision polishing operations therefore complicates the design of the carrier 14 and its accompanying electronics and controls. In some cases, even very expensive an complex controls are unable to ensure a uniform application of force since the carrier, which is measuring the forces, is continuously under frictional stress from the moving polishing pad 18.

In view of the foregoing, a need exists for a chemical mechanical planarization system that can provide a stable and accurate force to a substrate being planarized.

SUMMARY OF THE INVENTION

Broadly speaking, the present invention fills these needs by providing a chemical mechanical planarization system that has an adjustable platen. The adjustable platen is designed to apply a force to an underside of the polishing pad during operation, while the carrier is simply lowered into position over the polishing pad to achieve the appropriate planarization result. It should be appreciated that the present invention can be implemented in numerous ways, including as a process, an apparatus, a system, a device, or a method. Several inventive embodiments of the present invention are described below.

In one embodiment, a chemical mechanical planarization (CMP) system having a polishing pad, a wafer carrier, and an adjustable platen is disclosed. The adjustable platen includes a platen body and an air bearing that is integrated in the platen body for applying air pressure to an underside of the polishing pad. A set of bearings are connected to the platen body to enable movement of the platen body closer and further from the underside of the polishing pad. A load cell is connected to the platen body, and the load cell is configured to output a load signal that is indicative of a force being applied to the underside of the polishing pad. An air supply for applying air flow to the air bearing is also provided. The air flow is adjustable in response to changes in the force being applied to the underside of the polishing pad.

In another embodiment, an adjustable platen is disclosed. The adjustable platen includes a platen body having a top region and a bottom region. The platen body is oriented under a linear polishing pad. An air bearing is integrated with the platen body at the top region, and the air bearing is configured to apply an air pressure to an underside of the linear polishing pad. A set of bearings are connected to the bottom region of the platen body to enable controlled movement of the top region of the platen body closer or further from the underside of the linear polishing pad depending on the applied air pressure. The applied air pressure is configured to exert a controllable force to the underside of the linear polishing pad.

In yet another embodiment, another platen is disclosed. The platen includes a platen body having a top region and a bottom region. The platen body is positioned under a linear polishing pad of a chemical mechanical polishing (CMP) system, and the CMP system is designed to receive a wafer to be polished on a top surface of the linear polishing pad when positioned for processing by a spindle and carrier of the CMP system. An air bearing is coupled with the platen body at the top region, and the air bearing is configured to deliver an air flow to an underside of the linear polishing pad. A set of linear bearings are coupled to the bottom region of the platen body to enable controlled vertical movement of the platen body closer and further from the underside of the linear polishing pad. The vertical movement of the platen body is determined by the air flow, and the air flow is variable so as to set a desired force to the underside of the linear polishing pad.

In still another embodiment, a platen design is disclosed. The platen includes a platen body having a top region and a bottom region. The platen body is positioned under a linear polishing pad of a chemical mechanical polishing (CMP) system, and the CMP system is designed to receive a wafer to be polished on a top surface of the linear polishing pad when positioned for processing by a spindle and carrier of the CMP system. An air bearing is coupled with the platen body at the top region, and the air bearing is configured to deliver a fixed air flow to an underside of the linear polishing pad. A load cell for determining a force being applied to the underside of the linear polishing pad by the fixed air flow is integrated with the platen body. An actuator provided to vertically adjust the platen body closer and further from the underside of the linear polishing pad.

The advantages of the present invention are numerous. Most notably, by having the platen apply controlled forces from under the polishing pad, the spindle controlling the wafer carrier can be greatly simplified, and can eliminate the need for a splined spindle and complicated monitoring and compensating electronics. As is well known, the splines spindle is a mechanical device that allows for rotational motion about it's long axis while allowing for translation about the same axis. Furthermore, the bearing(s) used to guide the platen are not affected by frictional forces, which eliminates the hystersis problems caused by side forces. Additionally, placing the load cell behind the platen as described in one of the possible system configurations would greatly reduce the complexity and cost of the load cell as well as dramatically increase reliability. Other aspects and advantages of the invention will become apparent from the following detailed description, taken in conjunction with the accompanying drawings, illustrating by way of example the principles of the invention.

BRIEF DESCRIPTION OF THE DRAWINGS

The invention, together with further advantages thereof, may best be understood by reference to the following description taken in conjunction with the accompanying drawings.

DETAILED DESCRIPTION OF THE PREFERRED EMBODIMENTS

An invention is disclosed for a chemical mechanical planarization system that includes an adjustable air platen. The adjustable platen is designed to apply a force to an underside of the polishing pad during operation. Air is preferably supplied in an adjustable and controlled manner through the platen and directed toward the underside of the polishing pad. The force is preferably monitored by incorporating a load cell into the platen, and adjustments are made to the air flow to appropriately modify the applied force. The carrier, however, is simply designed to move the carrier into position over the polishing pad to achieve the appropriate planarization result. In one specific embodiment, the force applying platen will include an integrated air bearing that provides force to the back of a polishing pad. This force is then transmitted to the wafer through the front of the polishing pad causing the mechanical abrasion forces required for CMP on a linear belt technology system. To apply the force through the platen, an actuator is placed behind the platen. The actuator can take on many forms, such as pneumatic, hydraulic, mechanically driven, or electromagnetically driven.

In the following description, numerous specific details are set forth in order to provide a thorough understanding of the present invention. It will be apparent, however, to one skilled in the art that the present invention may be practiced without some or all of these specific details. In other instances, well known process steps have not been described in detail in order not to unnecessarily obscure the present invention.

Figure 1:
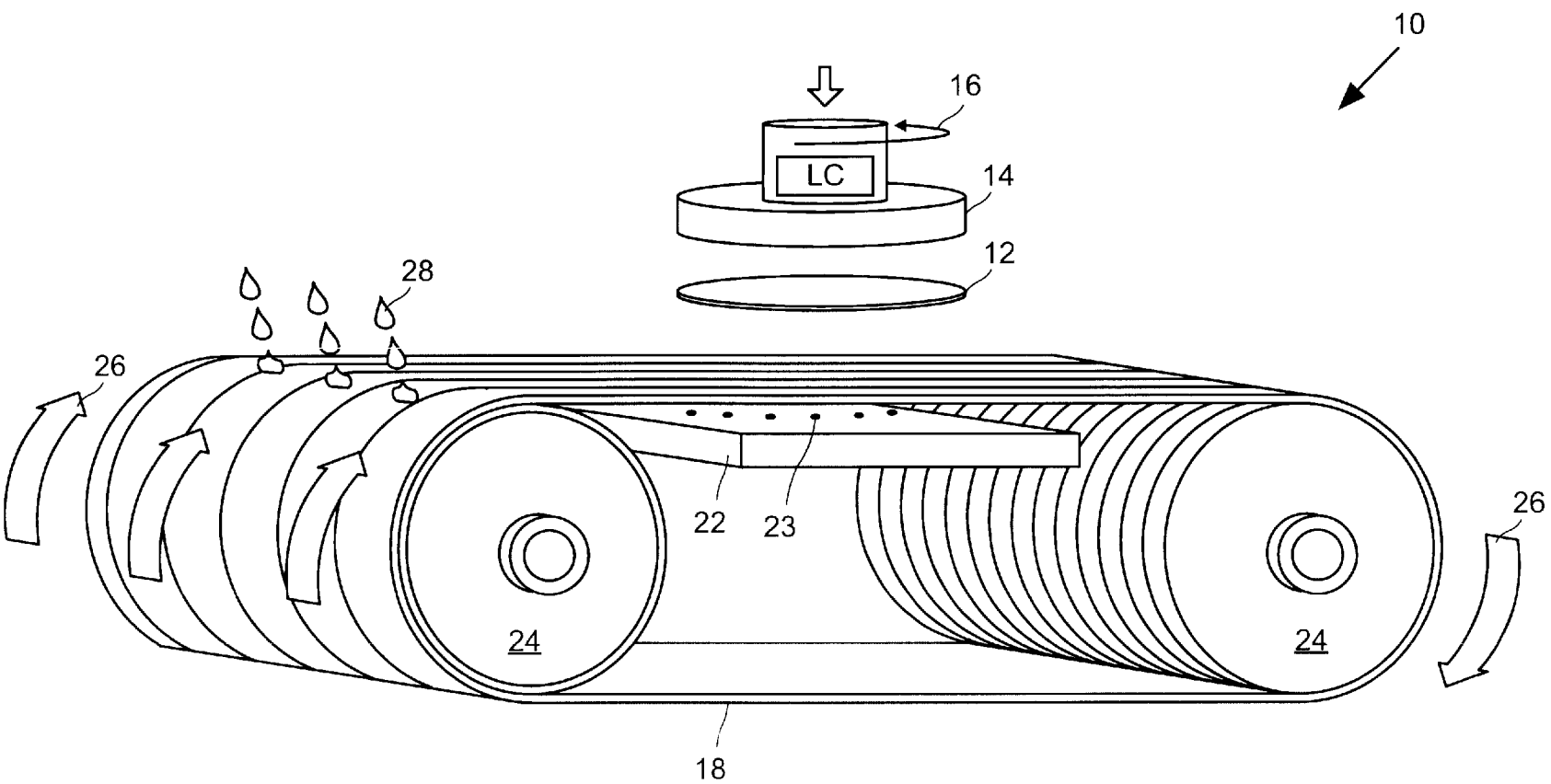
FIG. 1 (Prior Art)
FIG. 1 is an illustration showing an exemplary prior art CMP system.
Figure 2:
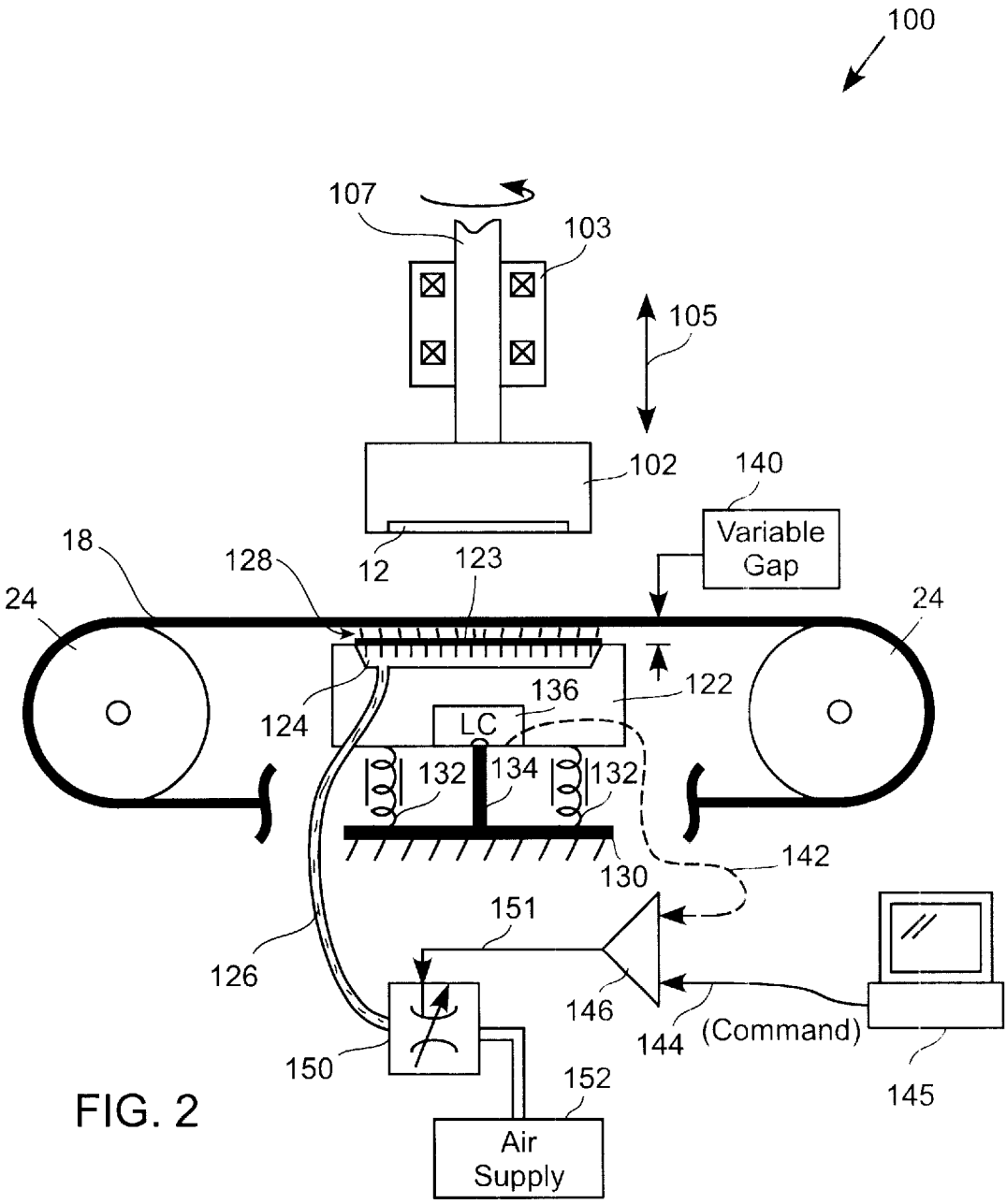
FIG. 2 shows a chemical mechanical planarization (CMP) system including an adjustable platen, in accordance with one embodiment of the present invention.

FIG. 2 shows a chemical mechanical planarization (CMP) system 100 including an adjustable platen 122, in accordance with one embodiment of the present invention. The CMP system 100 includes a pair of drums 24 which are configured to receive a polishing pad 18 and move the polishing pad linearly around the drums. A carrier 102 is provided, including a wafer 12 that is designed to be lowered over the moving surface of the polishing pad 18 during processing by a spindle. The carrier 102 is connected to a spindle holder 103 that secures a spindle 107 in an aligned position relative to the polishing pad 18.

In this embodiment, the carrier 102 is designed to have a vertical motion such that the wafer 12 can be moved up and down relative to the polishing pad 18 and also be provided with rotational motion as induced by the spindle on the carrier 14. Once the carrier 102 is moved to the polishing pad 18 surface and polishing commences, the carrier 102 is no longer monitored for controlled adjustment up or down to achieve a varied pressure for processing the wafer 12. In this embodiment, the adjustable platen 122 is designed to either apply more or less pressure under the polishing pad 18 in a location directly below the carrier 102. The applied pressure therefore exerts a force to the underside of the polishing pad 18. This force, as will be discussed below, can be varied to achieve the desired processing of the wafer 12. The adjustable platen 122, as shown has a platen body having a top region and a bottom region. The top region, in one embodiment, can receive an air bearing 126. Accordingly, the air supplied by the adjustable platen 122 is delivered by way of an air supply line 126 that feeds air into and is distributed by the air bearing 124. The air bearing 124 can have zones, which are optimized and controlled to deliver optimized air flow to desired regions under the polishing pad 18. In this manner, the wafer 12 can be polished to the optimum level desired by an end user.

The air bearing 124, in one embodiment, provides the air to the region between the polishing pad and the adjustable platen 122. The air forms an air cushion 128 that applies pressure to the under surface of the polishing pad during operation. The adjustable platen 122 is coupled to a reference surface 130 by way of linear bearings 132. The linear air bearings 132 are, in one embodiment, spring loaded. In this manner, the adjustable platen 122 will naturally be pushed to a neutral uncompressed position that is away from the reference surface. The reference surface 130 also has a connector 134 that is coupled to a load cell 136. The load cell can by any type of load cell that measures pressure, outputs an analogy signal that can then be digitized for analysis. One example commercially available load cell may be a LPU-500-LRC low profile tension and compression load cell available from Transducer Techniques, located in Temecula, Calif. For more information on load cells and methods for using the same, reference can be made to U.S. Pat. No. 6,083,082, issued Jul. 4, 2000, by Miguel A. Saldana in the name of Assignee Lam Research Corporation. This patent is herein incorporated by reference.

The adjustable height connector 134 is shown in simplified form, and it should be understood that any conventional load cell connector or structure that may be adjusted for platen height by a mechanical device, such as a lead screw, a piston, a shaft, an actuator, and the like can work. The reference surface 130, as used herein, should be understood to include any surface that can provide support or the adjustable platen 122. The load cell 136 is designed to measure the amount of force being exerted by the adjustable platen 122 as it pushes downward toward the reference surface 130. In this embodiment, the load cell 136 is designed to provide a load signal 142 that indicates the amount of loading being experienced by the adjustable platen 122. The load signal 142 is provided to a comparator 146. The comparator 146 is further configured to receive a command signal 144 from a control station 145.

As is well known, a control station 145 can be used to provide a recipe of preprogrammed pressures and other controlling parameters that are appropriate for a given CMP operation. For example, the recipe can be designed for the planarization of oxides, metals, or combinations of oxides and metals. Once the command signal 144 has been provided to the comparator 146, the comparator and its electronics will then compare the command signal 144 with the load signal 142 to produce a signal 151 that is appropriate for the application and is in conformance with the recipe being applied. As shown, the signal 151 is supplied to a flow controller 150.

The flow controller 150 is designed to be coupled to an air supply 152. The air supply 152 can be any air supply, such as one that may be part of a clean room or the like. Once the air flow controller 150 has received the signal 151, the appropriate amount of air pressure is supplied through the air supply line 126 to the adjustable platen 122. By applying additional air flow through the air supply line 126, additional pressure will be exerted to the under surface of the polishing pad 18 during the processing of the wafer 12. As more air flow is directed to the under surface of the polishing pad 18, a variable gap 140 will become enlarged, while still exerting additional pressure to the underside of the polishing pad 18.

It should be noted that all control for additional pressure is controlled by the adjustable platen 122, and no longer required of the carrier 102. As such, the carrier design can now be simplified as it only requires the control of up-down parameters and rotational parameters.

Figure 3A:
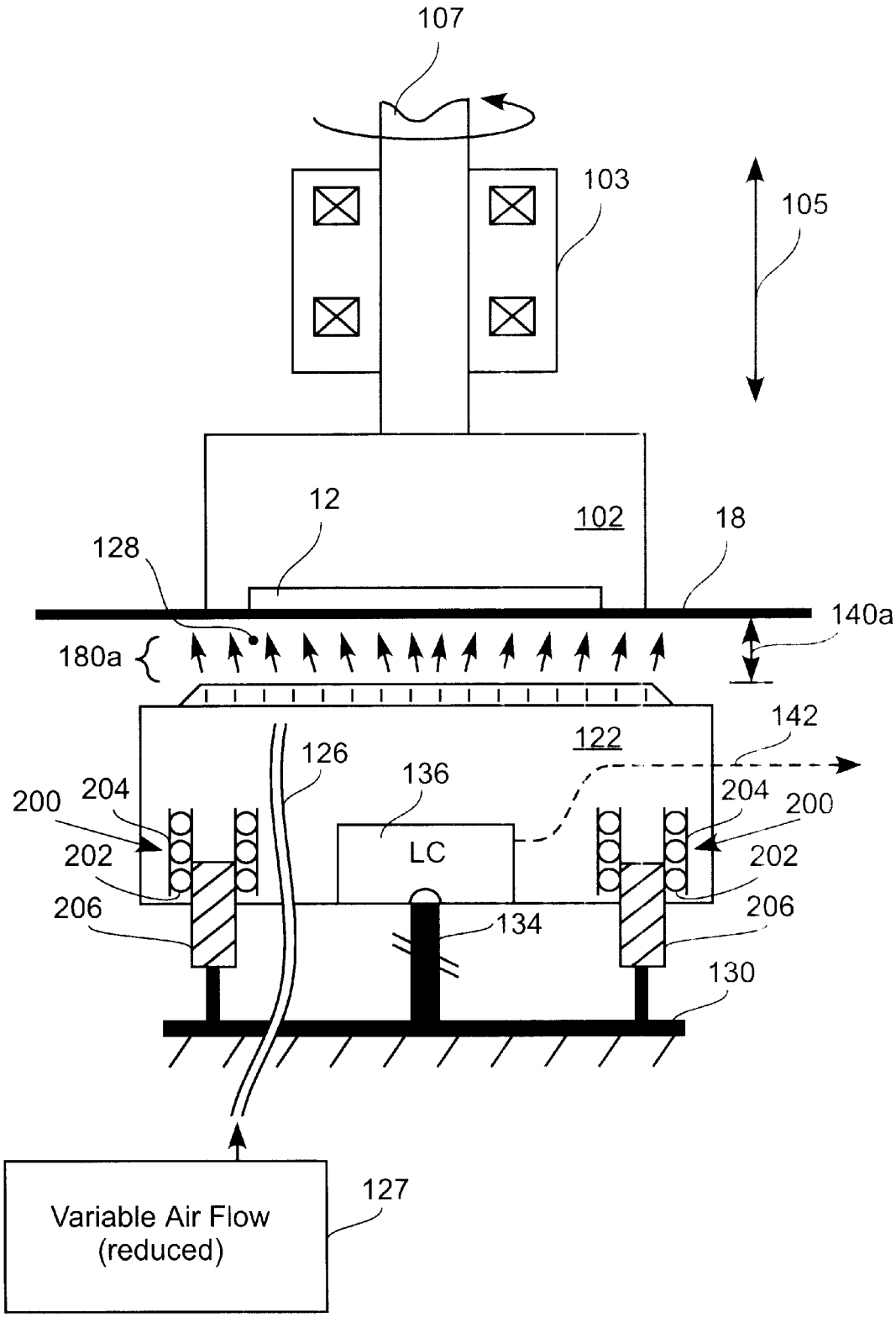
FIGS. 3A–3C show a more detailed views of the adjustable platen relative to the linear polishing pad, in accordance with one embodiment of the present invention.

FIG. 3A shows a more detailed diagram of the adjustable platen 122 relative to the polishing pad 118, in accordance with one embodiment of the present invention. In this illustration, the carrier 102 has been applied to the polishing pad 18 so as to bring the surface of the wafer 12 in contact with the polishing pad 18. During processing, it is assumed that appropriate amounts of slurry have been applied to the polishing pad 18 to achieve the appropriate level of polishing. In the down position as shown by up-down position 105, the spindle 107 is designed to be in rotational movement. In this embodiment, the air cushion 128 is shown with an air flow 180*a* that produces a gap 140*a*. The variable air flow 127 is, in this example, applied at a reduced amount since the recipe for the particular CMP operation may not require large pressure from under the polishing pad 18. During operation, the load cell 136 is providing information by way of load signal 142, which is supplied to the comparator 146.

If additional pressure is desired at any time during the polishing operation, the variable air flow 127 will apply additional air flow 180*a* to produce a gap which is slightly larger than 140*a*. In this embodiment, linear bearings 200 enable a shaft 206 to traverse up or down as additional or less air is supplied to the gap 104*a*. In this example, the linear bearings 200 include a cage 204 and a plurality of ball bearings 202. The ball bearings 202 will allow the shaft 206 to move up and down in a Z direction without introducing an X or Y component. It is also important to note that the frictional forces present in the prior art do not apply to the linear bearings 200 since the platen 102 is not in frictional contact with the polishing pad 18. Thus, the frictional forces will not impact the measuring of the force through the load cell 136, and thus, more accurate force results can be measured and in turn applied.

Figure 3B:
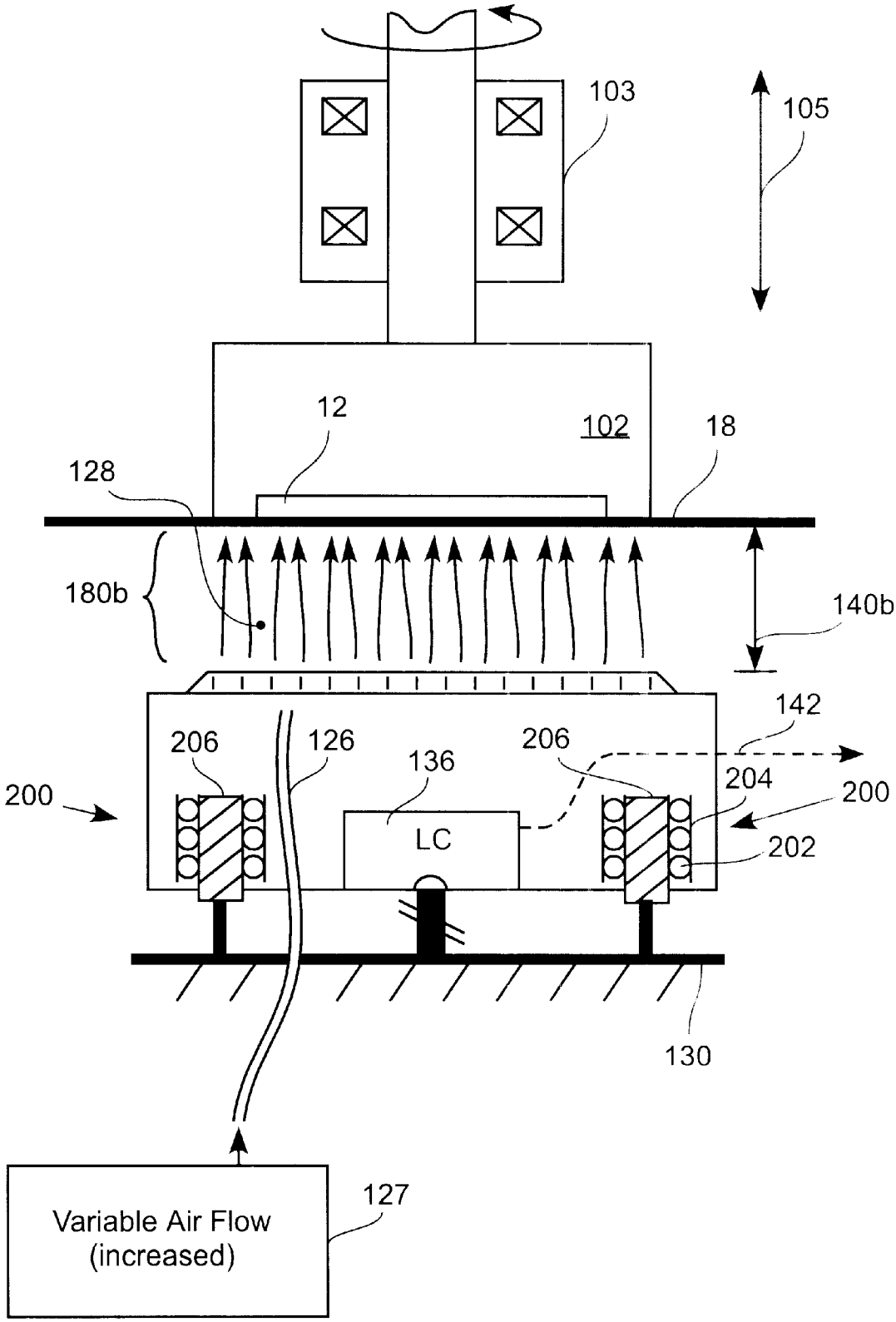

FIG. 3B shows yet another example of the adjustable platen 122 in which increased air flow is supplied to the air supply line 126 and therefore to the underside of the polishing pad 18. The air flow 180*b* is illustrated to be more intense than the air flow 180*a* of FIG. 3A. Similarly, because additional air flow has been provided, the gap 140*a* of FIG. 3A is now increased to gap 140*b* as shown in FIG. 3B. As additional air is supplied through the air supply line 126, the adjustable platen 122 will move downward toward the reference surface 130. This movement is also monitored by the load cell in terms of force, thus providing the accurate feedback to the pressure control system.

Figure 3C:
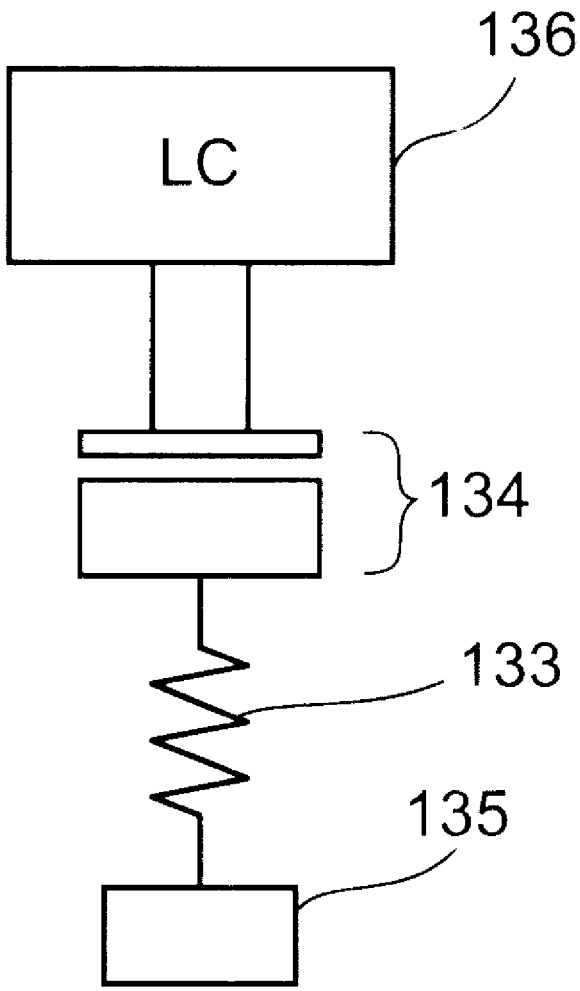

By way of example, the adjustable platen 122 is shown with shafts 206 in a moved-in position within the linear bearings 200. As shown in FIG. 3C, in one embodiment, the load cell connector 134 will preferably compress a spring 133 or other suitable resistive element. A Z-adjustment 135 can also be included for fine tuning of a reference surface. The Z-adjustment 135 can be, for example, a lead screw, an adjustable connector, a piston, or other suitable device that con provide precision positioning. The spring element 133 may have a mechanical stiffness that can be varied in order to vary the mode of operation of the proposed invention. When the stiffness is low relatively speaking and the spring 133 is compressed for a given pressure setpoint, the adjustable platen 102 will be driven upward when less air is supplied, thus closing the gap between the belt and the platen 102 as the system reaches equilibrium. In a more preferred embodiment, the mechanical stiffness of the spring or resistive element is great as it is replaced by a rigid mechanical connection. Thus, while the air supply rate is dropped, the density of the air between the platen and the belt reduces thereby reducing the resulting pressure on the wafer. Note that in this alternative embodiment, the platen is not driven upward when the air supply is decreased.

Of course, during a CMP operation, the load cell 136 will continue to provide loading information by way of the load signal 142. If the recipe supplied by the control station 145 requires less pressure to be applied to the underside of the polishing pad 18, the command signal 144 will be adjusted such that the signal 151 will command the flow controller 150 to apply less air through the air supply line 126.

Figure 4:
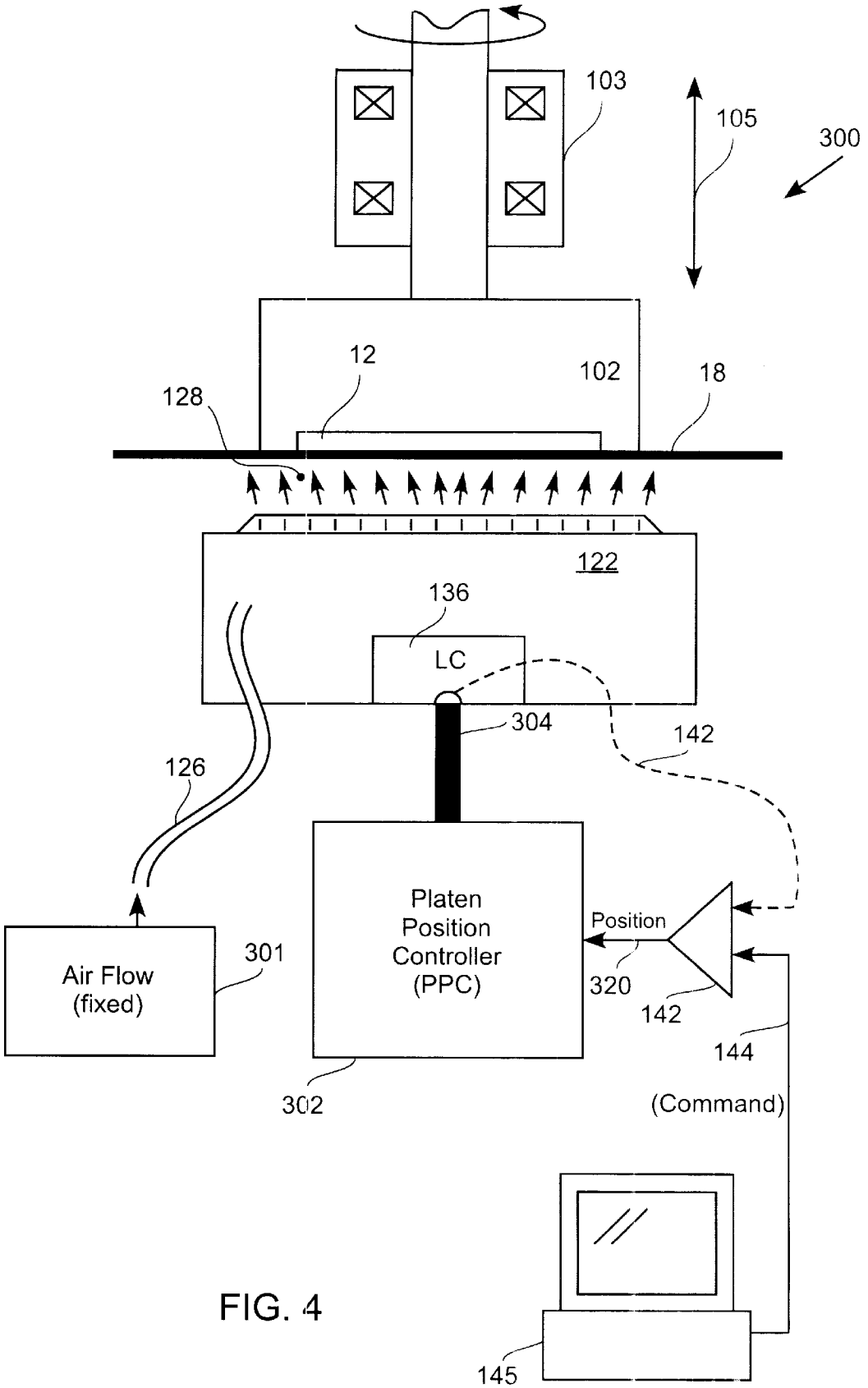
FIG. 4 illustrates a platen delivering a fixed air flow and being adjustable in vertical position to generate a desired pressure to the underside of the linear polishing pad.

FIG. 4 illustrates another embodiment in which an adjustable platen 122 is implemented below a polishing pad 18, in accordance with one embodiment of the present invention. The adjustable platen 122 includes a load cell 136 which is also configured to produce a load signal 142. However, instead of coupling the adjustable platen 122 to a reference surface 130, a shaft 304 coupled to a platen position controller (PPC) 302 is provided. The PPC 302 is configured to receive a position signal 320 from the comparator 142. The comparator 142 is configured to receive the load signal 142 as well as the command signal 144 from the control station 145.

As mentioned above, the command signal 144 provided to the comparator 142 is in accordance with a particular recipe that is designed to define the variables for the polishing of the wafer 12. In this embodiment, the air flow provided by way of the air supply line 126 to the adjustable platen 122 will be fixed 301, instead of having a variable air flow 127. Accordingly, it is not the air flow that will move the adjustable platen away form the under surface of the polishing pad 18, but the platen position controller (PPC). Accordingly, if more force is required, the adjustable platen 122 will be moved closer to the under surface of the polishing pad 18. If less force is required, the adjustable platen will be moved away since the air flow is fixed. The fixed air flow 301, however, will still provide the air cushion 128 between the polishing pad 18 and the adjustable platen 122.

In this embodiment, the shaft 304 can be driven by any type of actuator. For example, the actuator can be a mechanically actuator, a pneumatic actuator, a hydraulic actuator, or an electromagnetic actuator. The controls for such actuator devices may be closed loop servo-driven, this is in fact preferred. The adjustable air platen is then guided by a bearing system that may include one or several bearing guides. The air bearing design may be single zone or multi-zone in either single quadrant or multi-quadrant variations. The spindle is simplified considerably by eliminating the splined shaft requirement and replacing it with a more inexpensive conventional spindle shaft. As described above, closed loop control over force is done using a load cell as a force transducer. In one embodiment, the load cell may be installed either on the carrier wafer head, the platen or at the load application point.

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A chemical mechanical planarization (CMP) system having a polishing pad, a wafer carrier, and an adjustable platen, the adjustable platen comprising:

a platen body;

an air bearing integrated in the platen body for applying air pressure to an underside of the polishing pad;

a set of bearings connected to the platen body to enable movement of the platen body closer and further from the underside of the polishing pad;

a load cell being connected to the platen body, the load cell being configured to output a load signal that is indicative of a force being applied to the underside of the polishing pad;

an air supply for applying air flow to the air bearing, the air flow being adjustable in response to changes in the force being applied to the underside of the polishing pad; and a comparator for receiving the load signal and a recipe command, the recipe command being indicative of a desired pressure and the load signal being indicative of an actual pressure.

2. A chemical mechanical planarization (CMP) system of claim 1, wherein the platen body has a top region and a bottom region, the top region being proximate to the underside of the polishing pad and separate from the underside of the polishing pad by a gap.

3. A chemical mechanical planarization (CMP) system of claim 2, wherein the gap increases as the force applied to the underside of the polishing pad increases, and the gap decreases as the force applied to the underside of the polishing pad decreases.

4. A chemical mechanical planarization (CMP) system of claim 2, further comprising:

a flow controller for supplying the air flow to the air bearing.

5. A chemical mechanical planarization (CMP) system of claim 1, wherein the actual pressure is reduced to approximate the desired pressure.

6. An adjustable platen, comprising:

a platen body having a top region and a bottom region, the platen body being oriented under a linear polishing pad;

an air bearing integrated with the platen body at the top region, the air bearing being configured to apply an air pressure to an underside of the linear polishing pad; and a set of bearings connected to the bottom region of the platen body to enable controlled movement of the top region of the platen body closer or further from the underside of the linear polishing pad depending on the applied air pressure, the applied air pressure being configured to exert a force to the underside of the linear polishing pad.

7. An adjustable platen as recited in claim 6, further comprising:

a load cell connected to the platen body, the load cell being configured to output a load signal that is indicative of the force being exerted to the underside of the linear polishing pad.

8. An adjustable platen as recited in claim 6, further comprising:

an air supply being provided to the air bearing, the air supply having a flow rate that defines the air pressure.

9. An adjustable platen as recited in claim 8, wherein the air flow is adjustable in response to at least the load signal from the load cell.

10. An adjustable platen as recited in claim 8 being integrated into a chemical mechanical planarization (CMP) system, the system including, a carrier for holding a wafer to be processed, the carrier being designed to lower the wafer onto a top surface of the linear polishing pad that is substantially over the adjustable platen.

11. An adjustable platen as recited in claim 10, wherein the exerted force to the underside of the linear polishing pad is translated to the wafer being processed.

12. A platen, comprising:

a platen body having a top region and a bottom region, the platen body being positioned under a linear polishing pad of a chemical mechanical polishing (CMP) system, the CMP system is designed to receive a wafer to be polished on a top surface of the linear polishing pad when positioned for processing by a spindle and carrier of the CMP system;

an air bearing coupled with the platen body at the top region, the air bearing being configured to deliver an air flow to an underside of the linear polishing pad; and a set of linear bearings coupled to the bottom region of the platen body to enable controlled vertical movement of the platen body closer and further from the underside of the linear polishing pad, the vertical movement of the platen body determined by the air flow, the air flow being variable so as to set a desired force to the underside of the linear polishing pad.

13. A platen as recited in claim 12, further comprising:

a load cell integrated in the platen body, the load cell being configured to generate a load signal that is indicative of a current force being exerted to the underside of the linear polishing pad.

14. A platen as recited in claim 13, wherein the current force is modified to match the desired force by adjusting the air flow to the underside of the linear polishing pad.

15. A platen as recited in claim 12, further comprising:

an air supply for providing the air flow to the air bearing, the air supplying being controlled in response to achieve the desired force.

16. A platen, comprising:

a platen body having a top region and a bottom region, the platen body being positioned under a linear polishing pad of a chemical mechanical polishing (CMP) system, the CMP system is designed to receive a wafer to be polished on a top surface of the linear polishing pad when positioned for processing by a spindle and carrier of the CMP system;

an air bearing coupled with the platen body at the top region, the air bearing being configured to deliver a fixed air flow to an underside of the linear polishing pad;

a load cell for determining a force being applied to the underside of the linear polishing pad by the fixed air flow; and an actuator vertically adjusting the platen body closer and further from the underside of the linear polishing pad.

17. A platen as recited in claim 16, wherein the actuator is one of a mechanical actuator, a pneumatic actuator, a hydraulic actuator, and an electromagnetic actuator.

18. A platen as recited in claim 16, wherein a gap is defined between the underside of the linear polishing pad and a top portion of the air bearing, the gap providing an air cushion for the linear polishing pad.

19. A platen as recited in claim 16, wherein the spindle and carrier of the CMP system only includes vertical position control and rotation control and excludes pressure sensing and adjustment.

* * * * *